United States Patent [19]

van Rooij et al.

[11] Patent Number: 4,754,573

[45] Date of Patent: Jul. 5, 1988

[54] BASIC UNIT FOR THE ERECTION OF A SLIDING-DOOR

[76] Inventors: Henricus F. van Rooij, Rode Kruislaan 4, 1111 PB Diemen; Johannes J. M. Kompier, Joshof 30, 4813 EZ Breda, both of Netherlands

[21] Appl. No.: 939,639

[22] Filed: Dec. 9, 1986

[30] Foreign Application Priority Data

Dec. 13, 1985 [NL] Netherlands ..... 8503437
Jul. 4, 1986 [NL] Netherlands ..... 8601740

[51] Int. Cl.[4] ..... E06B 3/42; E06B 3/32; E05D 15/06

[52] U.S. Cl. ..... 49/370; 49/372; 49/380; 49/410

[58] Field of Search ..... 49/372, 409, 410, 380, 49/370

[56] References Cited

U.S. PATENT DOCUMENTS

| | | | |
|---|---|---|---|
| 834,649 | 10/1906 | Williams | 49/380 X |
| 1,221,766 | 4/1917 | Pitcher | 49/380 X |
| 2,378,666 | 6/1945 | Triller | 49/380 X |
| 2,561,079 | 7/1951 | Trammell, Sr. | 49/372 |
| 3,049,765 | 8/1962 | Elmore | 49/380 |
| 3,091,004 | 5/1963 | Mays | 49/372 |
| 3,276,166 | 10/1966 | Markus | 49/410 |
| 4,063,389 | 12/1977 | Leder | 49/372 X |
| 4,452,014 | 6/1984 | Markus | 49/409 X |
| 4,561,210 | 12/1985 | Kvas et al. | 49/372 |

*Primary Examiner*—Philip C. Kannan
*Attorney, Agent, or Firm*—Erwin S. Teltscher

[57] ABSTRACT

A sliding door unit has two spaced cabinets, a single top guiding rail extending between and in the cabinets, two bottom guiding rails extending in the cabinets, and a door with two door panels slidable into and out of the cabinets between the rails and having rollers fixable in depressed parts of the top guiding rail to fix the panels in open and closed position.

4 Claims, 5 Drawing Sheets

FIG. 1
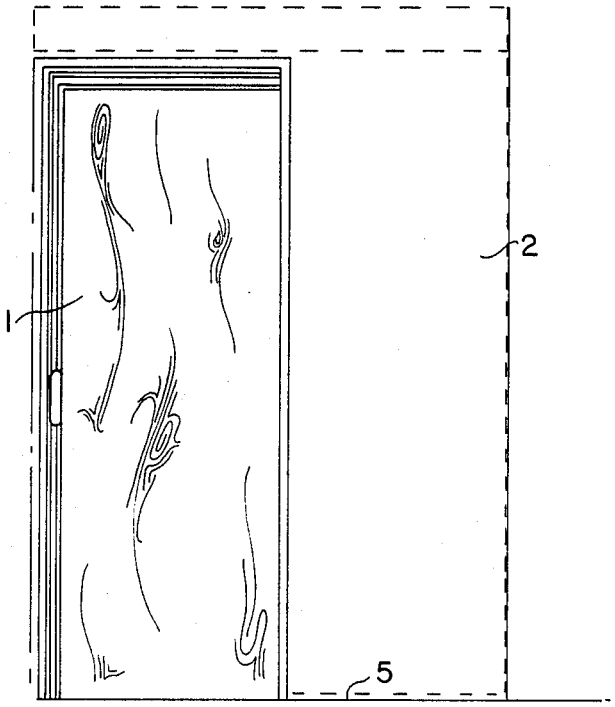
FIG. 2
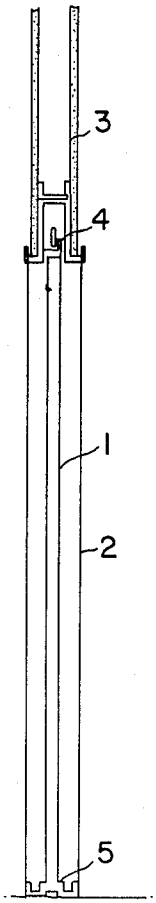
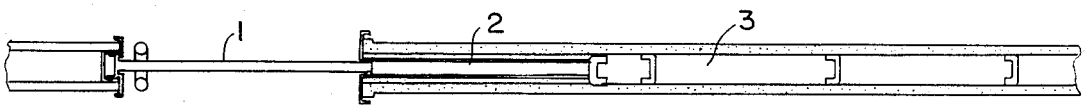
FIG. 3

FIG. 4
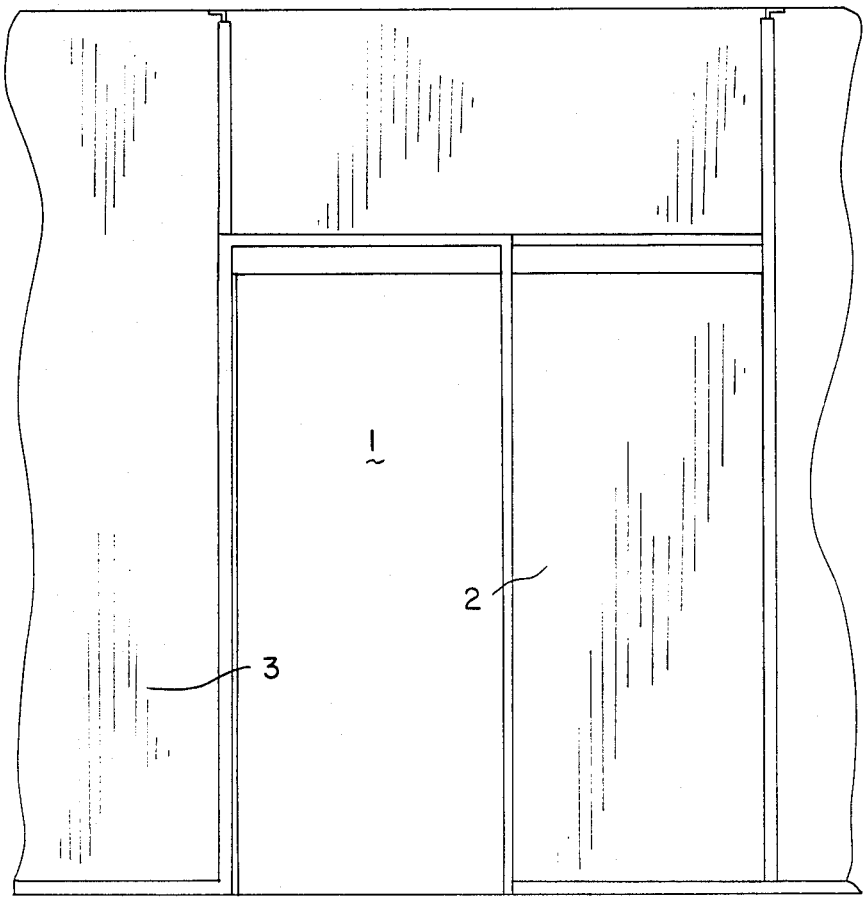
FIG. 5
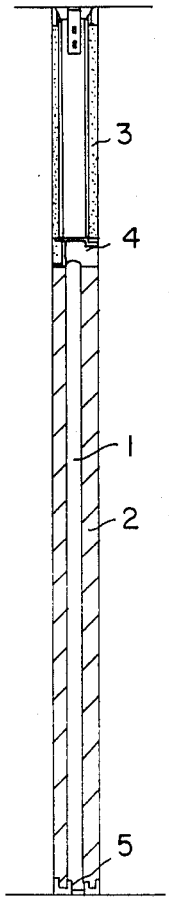
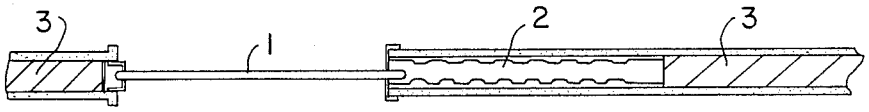
FIG. 6

FIG. 8
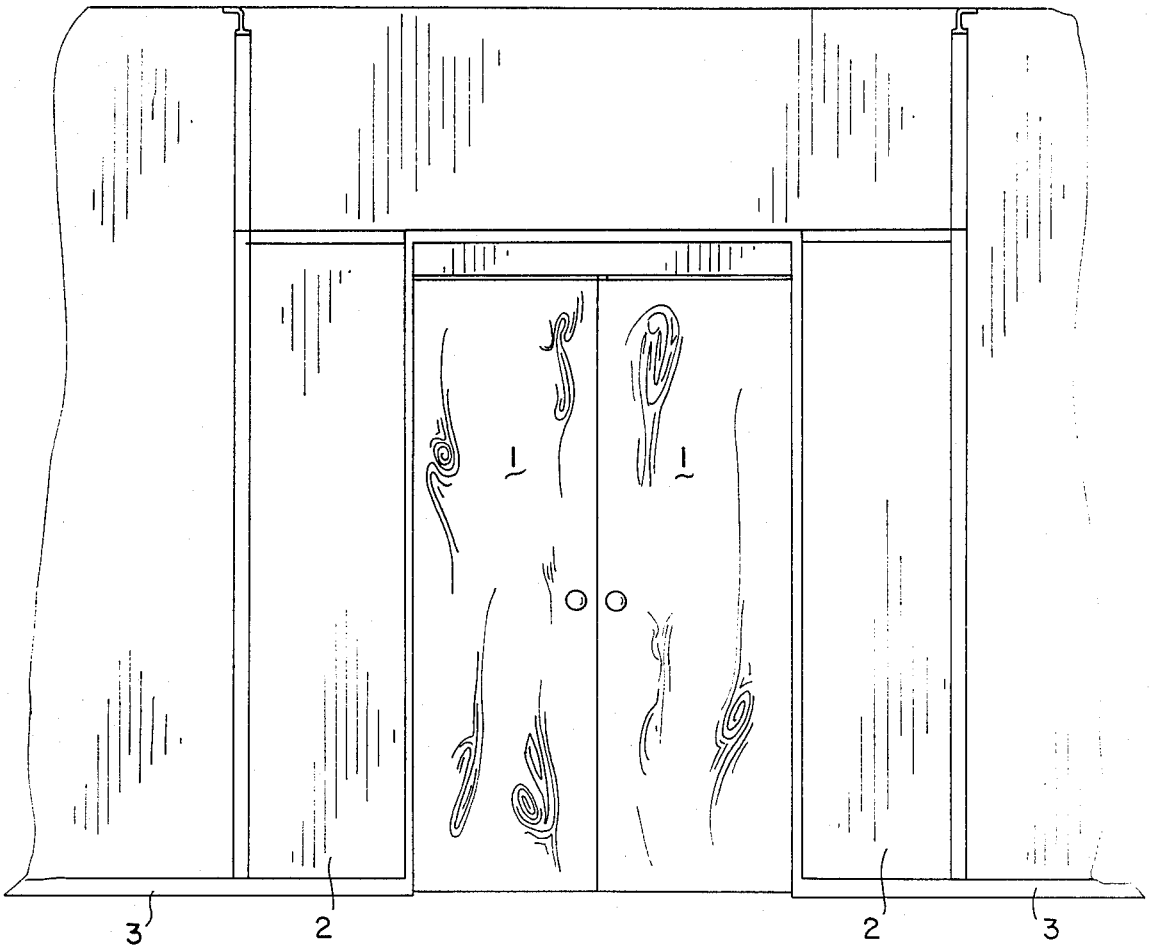
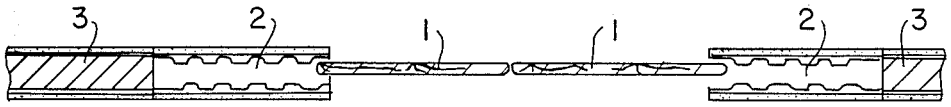
FIG. 9

BASIC UNIT FOR THE ERECTION OF A SLIDING-DOOR

BACKGROUND OF THE INVENTION

The present invention relates to a prefabricated basic unit for making door openings in walls which ought to be limited by means of sliding-doors. Conventional sliding-doors have certain advantages in room economy with regard to hinging and pivoting doors, because for opening less space is disposed of the available room.

The disadvantage of the conventional sliding-doors however is the necessity to make reservations next to the door passage to create the possibility of sliding along the wall, and consequently the place where the door stands in its open position should be kept free, and nothing else can be placed there.

Furthermore the prior art sliding-doors give rise to construction problems, since a heavy casing and a door trim and rail construction ought to be mounted, while several other provisions must be applied for positioning said doors. In the French Patent Application Nr. No. 70.35.782 a sliding door structure is described, which comprises a vertical framework with a rail along its upper side upon which pairs of wheels carrying the door panel are rolling, and a rail along the floor, provided with vertical edges, between which horizontal rollers mounted at the lower edge of the door panel are guided; a sealing ribbon is also positioned at the lower edge of the door panel, but at the spots of the rollers said sealing ribbon ought to be omitted.

A free passage without a threshold cannot be realized with this construction, and draught cannot be totally obviated.

There are no means for keeping the door panel in a certain partly or entirely open or closed stand.

The construction requires much labour and it is expensive, while the appearance remains less attractive and standardization could not be realized.

SUMMARY OF THE INVENTION

The said disadvantages are obviated with the sliding-door unit according to the present invention, while general advantages of the sliding-door are performed in a better way as yet.

The basic unit for a sliding-door according to the present invention comprises a door panel with door jambs,characterized in that the entire unit is independently supporting and provided with fastening means ready for erection, and consists of a cabinet which is open on one of its narrow sides and bordered by jambs, while the door panel is slidable at one guiding rail at the uppermost side into and out of said cabinet, and opposite to said narrow side a profile is provided which can be put up between two jambs against the end of a wall, and the guiding rail is provided with means for keeping the door panel in open or closed stand.

The upper rail is a straight rail consisting of a profile wherein the rollers are positioned, which are bearing the door panel, and according to the invention the said rail comprises interposed parts which are put in a somewhat lowered horizontal position, such that the door by the lowering of the rollers on said parts moves slightly downwards at the prescribed stand, which corresponds with the resting points in the open or closed position respectively.

By these interposed lowered parts in the upper rail the movement of the door can be defined at the fixed resting spots.

The result is a firm position in the open or closed configuration. The wall elements wherein said basic unit can be put up are preferably gypsum board walls or similar elements, which can be displaced or removed just like the cabinet, and which are circumfered with framing edges, to be affixed at regular distances by connection means at the floor and to the ceiling.

The panel of the door is provided with straight bearing means which hitch on to the guiding rail provided with fixation spots, said rail extending in said cabinet and over the passage opening at the upper rim, while inside the cabinet a guidance rail can be used, which does not extend out of the cabinet.

The door panel may be made either entirely or in part of wood, reinforced gypsum or plastics material, such as polyester or polyurethane and/or glass, with framing edges (rims) as desired.

The cabinet for the installation of the sliding door can be erected together with the placement of the wall at the location desired.

In case of existing walls a part of the wall or a wall-panel corresponding with the surface area of the cabinet can be taken away and substituted by the cabinet for the erection of the sliding-door.

The prefabricated structure of the basic unit is also suited for positioning in hollow walls.

In this case the door panel slides out of the space between the two planes of the hollow wall and back into said space.

Such hollow walls are often constructed with dutch bricks or clinkers with a space for ventilation in between.

The lower side of the cabinet is fastened to the floor and the upper side with the upper rail is mounted in an upper part of the wall or at the ceiling.

The advantages in use of this unit are light-weight, the easy way of mounting, the possibility of removal, the absence of draught, and the saving of room space.

These are of particular importance for offices, schools, hospital wards, laboratories, meeting-rooms, restaurants, boarding-houses etc. The sizes will be of a standardized assortment, which is adapted to the frequently occurring width and height of door passages and to the height of rooms and halls as required.

It is observed however that the unit can be mounted in any room between the floor and the ceiling, irrespective of its height.

Another advantage is the light-weight and nevertheless strong construction of the entire cabinet unit, which moreover renders esthetic performance. Still another advantage is the substantial saving in space which is obtained since the door-cabinet-unit is set up as a part of the wall; this is in contrast with the prior art sliding-door systems, which always occupy a part of an existing wall or of a wall to be built, and which remain visible in drawn-open position as yet.

If there exists a space at disposal between the upper rim and the ceiling of the room an automatic device effecting the opening and shutting and/or an alarm system can be mounted in a housing between the upper rim and the ceiling.

These can be operated by means of sensors in case of fire or if smoke is caused, e.g. sliding the door out of the cabinet when the sensor perceives fire or smoke, such that the passage is closed.

Of its very nature sensors perceiving burglary can be mounted at the door. The cabinet can be made of gypsum board panels comprising reinforcements of strips of e.g. aluminium or wood.

The door can be a single door or it may consist of two door parts. In the first case a cabinet is needed with the sizes of the single slidingdoor, in the second case there are two cabinets into each of which one of the door bodies can slide separately.

The part on top of the cabinet and the door passage can be constructed in a telescopic manner, such that the complete unit can be mounted in rooms of different heights.

The door and the cabinet can be provided with a layer of heat- and noise-insulating material, such as foam-plastic or honeycomb-laminate.

These materials are light-weight and of sufficient strength for the purpose envisaged.

As the lower rail is not or only slightly extending outside the cabinet part, the floor remains plain and a floor-covering can be laid continuously from one room into another.

The novel features of the present invention are set forth in particular in the appended claims. The invention itself however will be best understood from the following description of preferred embodiments which is accompanied by the following drawings.

BRIEF DESCRIPTION OF THE DRAWINGS

FIG. 1 is a front view showing a door unit in accordance with the present invention;

FIG. 2 is a view showing a vertical cross section of the door unit of FIG. 1;

FIG. 3 is a view showing a horizontal cross-section of the door unit of FIG. 1;

FIG. 4 is a front view of a door unit in accordance with another embodiment of the present invention, with a door of a transparent material;

FIG. 5 is a view showing a vertical section of the door unit of FIG. 4;

FIG. 6 is a view showing a horizontal cross-section of the door unit of FIG. 4;

FIG. 8 is a front view showing the door unit in accordance with a further embodiment of the present invention , with a two-part sliding door;

FIG. 9 is a view showing a horizontal cross-section of the door unit of FIG. 8.

DESCRIPTION OF PREFERRED EMBODIMENTS

Figure 7:
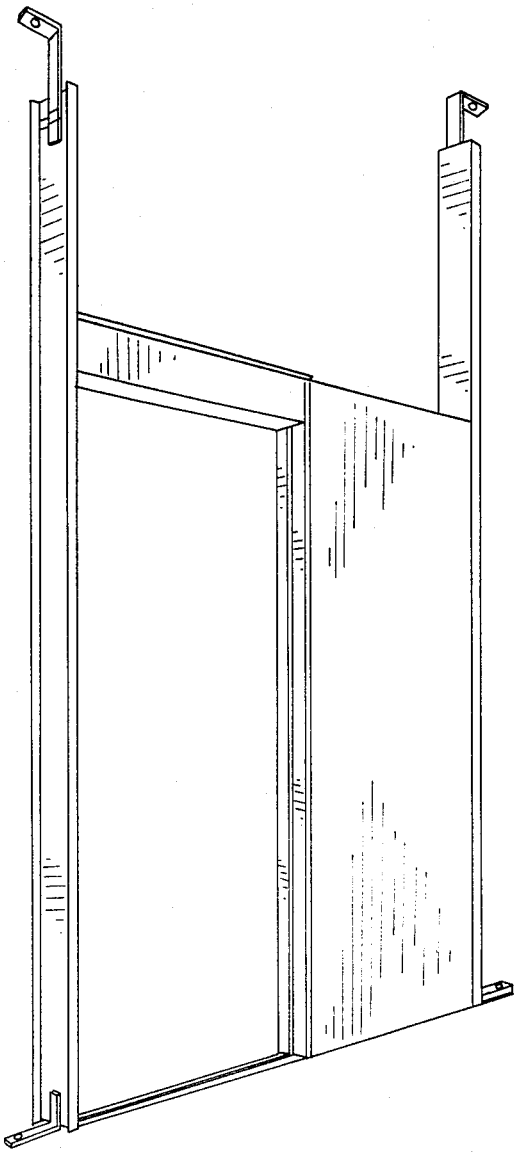
FIG. 7 is a view showing the door unit of the present invention on a perspective.
Figure 10:
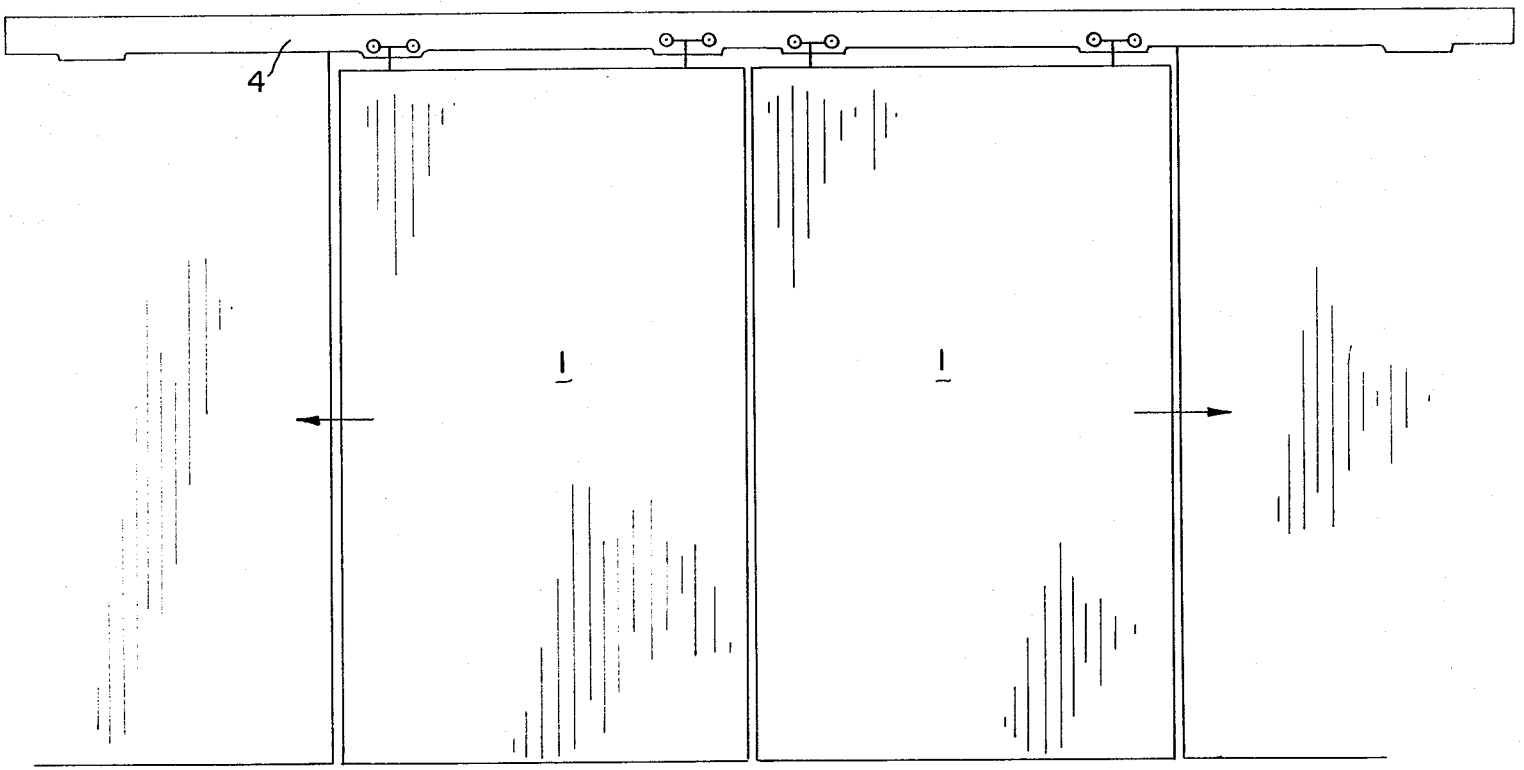
FIG. 10 is a view corresponding to the view of FIG. 8, but showing some additional details of the door unit of this embodiment.

FIGS. 1–3 show a first embodiment of a door unit in accordance with the present invention. The door unit has a sliding door 1 and a cabinet 2. The cabinet 2 is open at its left side, so that the door 1 can slide into the cabinet and out of it. Reference numeral 3 identifies a wall part in which the cabinet is arranged. Rails 4 and 5 are provided for guiding the door 1 during its sliding.

FIGS. 4–6 show a second embodiment of the door unit in accordance with the present invention. Here the door 1 is made of a transparent material, such as glass or plastic. The cabinet 2 has a corrugated wall for increasing its strength. The transparent door 1 is slidable into and out of the cabinet 2.

FIGS. 8 and 9 show a third embodiment of the door unit of the present invention. The door here is formed as two-panel door which includes door panels 1. The door unit has two cabinets 2 each associated with a respective one of the door panels. The door panels 1 are slidable into and out of the respective cabinets 2. A single horizontal rail extends above both door panels, as can be seen from FIG. 2. Both panels are slidable on this single rail. The rail has lowered parts formed so that the rollers attached to the panels can rest on these lowered parts in open and closed positions of the respective panels.

The invention is not limited to the details shown since various modifications and structural changes are possible without departing in any way from the spirit of the invention.

What is desired to be protected by Letters Patent is set forth in particular in the appended claims.

We claim:

1. A sliding door unit for buildings and the like, comprising two cabinets spaced from one another by a predetermined distance and each having a predetermined width;

a single guiding rail extending substantially over said distance between said cabinets and over said width of both of said cabinets in a top region of said cabinets;

two further guiding rails each extending only over said width of a respective one of said cabinets in a bottom region of said cabinets;

a door having two door panels each provided with rolling means arranged to roll on said single guiding rail so that each of said door panels is movable into and out of a respective one of said cabinets being rolled over said single guiding rail and guided over said further guiding rails; and means for fixing each of said door panels in its open and closed positions.

2. A sliding door unit as defined in claim 1,wherein said rolling means is formed as two rollers provided in a top region of each of said door panels, said fixing means including downwardly recessed parts of said single guiding rail, formed so that said rollers rest in a respective one of said recessed parts of said single guiding rail in a respective one of said positions.

3. A sliding door unit as defined in claim 1, wherein said single guiding rail and said further rails are located inside said cabinets, so that no sills or rails are needed outside said unit.

4. A sliding door unit as defined in claim 1, wherein each of said cabinets has an open side facing toward the other cabinet and is bordered by jambs.

* * * * *